US010619369B1

(12) United States Patent
Herd

(10) Patent No.: US 10,619,369 B1
(45) Date of Patent: Apr. 14, 2020

(54) INFLATABLE POOL COVER

(71) Applicant: Margaret Jean Herd, Glen Burnie, MD (US)

(72) Inventor: Margaret Jean Herd, Glen Burnie, MD (US)

( * ) Notice: Subject to any disclaimer, the term of this patent is extended or adjusted under 35 U.S.C. 154(b) by 0 days.

(21) Appl. No.: 15/860,485

(22) Filed: Jan. 2, 2018

Related U.S. Application Data

(63) Continuation-in-part of application No. 14/742,819, filed on Jun. 18, 2015, now abandoned, which is a continuation of application No. 12/378,880, filed on Feb. 20, 2009, now abandoned, which is a continuation-in-part of application No. 11/726,299, filed on Mar. 21, 2007, now abandoned.

(60) Provisional application No. 60/803,285, filed on May 26, 2006.

(51) Int. Cl.
*E04H 4/10* (2006.01)

(52) U.S. Cl.
CPC ..... *E04H 4/103* (2013.01)

(58) Field of Classification Search
CPC ..... E04H 4/103
USPC ..... 4/499
See application file for complete search history.

(56) References Cited

U.S. PATENT DOCUMENTS

| | | | | | |
|---|---|---|---|---|---|
| 3,355,745 | A * | 12/1967 | Jannuzzi | E04H 4/106 | 4/503 |
| 3,533,110 | A * | 10/1970 | Gisondi | E04H 4/103 | 4/499 |
| 3,608,099 | A * | 9/1971 | Wall | E04H 4/105 | 4/499 |
| 3,683,427 | A * | 8/1972 | Burkholz | E04H 4/108 | 4/499 |
| 4,953,239 | A * | 9/1990 | Gadsby | E04H 4/103 | 4/499 |
| 5,144,704 | A * | 9/1992 | Genzel | E04H 4/103 | 4/499 |
| 6,286,157 | B1 * | 9/2001 | Baumann | E04H 4/103 | 4/499 |
| 7,874,023 | B1 * | 1/2011 | Sundling | E04H 4/105 | 4/499 |
| 2007/0143915 | A1 * | 6/2007 | Vangelisti | E04H 4/103 | 4/499 |

* cited by examiner

*Primary Examiner* — Tuan N Nguyen
(74) *Attorney, Agent, or Firm* — Whiteford, Taylor & Preston, LLP; Peter J. Davis

(57) ABSTRACT

An assembly includes an inflatable, dome-like cover that is configured to rest atop an existing swimming pool. The cover has an inflatable portion that repels dirt, debris, water, and snow, preventing such debris from collecting thereon. The cover is produced from heavy duty, yet lightweight plastic or rubber material. The cover may sized and configured to fit a pool of any dimensions. Extending along a perimeter of the inflatable portion is a border about which openings are evenly spaced, through which tethers or cords may be tied for securing the assembly to the pool. At least one air valve is positioned proximal to the outer edge of the cover, enabling a user to inflate the assembly.

12 Claims, 11 Drawing Sheets

INFLATABLE POOL COVER

CROSS REFERENCE TO RELATED APPLICATION

This application is a continuation-in-part of U.S. patent application Ser. No. 14/742,819, filed with the U.S. Patent and Trademark Office on Jun. 18, 2015, which is a continuation of U.S. patent application Ser. No. 12/378,880, filed with the U.S. Patent and Trademark Office on Feb. 20, 2009, which is a continuation-in-part of copending and co-owned U.S. patent application Ser. No. 11/726,299 entitled "Worry-Free Inflatable Cover", filed with the U.S. Patent and Trademark Office on Mar. 21, 2007, by the inventors herein, which is based upon and claims benefit of U.S. Provisional Patent Application Ser. No. 60/803,285, filed with the U.S. Patent and Trademark Office on May 26, 2006 by the inventors herein, the specifications of which are incorporated herein by reference.

BACKGROUND OF THE INVENTION

Field of the Invention

This invention relates to pool covers and, more particularly, to an inflatable pool cover for preventing debris from entering a pool while simultaneously preventing fluids and debris from collecting on top of the pool cover and for allowing a user to easily remove the pool cover when desired.

Background

A favorite summertime activity enjoyed by millions of American consumers is going to a public or private swimming pool. A great way to beat the summer heat, spending time poolside can help ease the stresses of daily life, leaving one tanned, relaxed, and well rested. For children, aquatic activities are especially popular and long hours are spent splashing in the water and playing spirited games of "water tag" and "Marco Polo" with family and friends.

Because swimming, playing, or simply relaxing by a pool is such an enjoyable way in which to spend free time, many consumers opt to have an in-ground or aboveground swimming pool installed right in their own backyard. In fact, according to the National Pool and Spa Institute, nearly fifteen million households boast a residential swimming pool. Why are residential swimming pools so popular? Perhaps it is because they enable consumers to enjoy a variety of aquatic activities, without ever leaving their home. A practical alternative to transporting a carload full of kids, water toys, snacks, towels, and similar amenities to a local swimming pool, only to find that the pool is overcrowded with users, or in worse case scenario, closed to the public, owning a residential swimming pool allows consumers to step outside their back door and enjoy a quick swim, whenever desired.

Additionally, considering that the cost of constructing a swimming pool, particularly above-ground pools, is very reasonable, many consumers find that installing a residential swimming pool in their backyards is an affordable endeavor.

While there is little dispute that residential swimming pools provide consumers hours of summertime fun, their use is not without drawbacks. During the "off" seasons of autumn, winter and early spring, most swimming pool owners cover their pool with a thick plastic cover.

The usual winterizing procedure for a swimming pool involves cleaning the pool and applying chemicals to keep the water free from algae and bacteria. The chemicals may also include an antifreezing agent to keep the water from freezing with the concomitant expansion of the ice, which could burst the pool walls. Typically, an inflated plastic balloon is placed on the surface of the water and secured in place at the center of the pool. Then, a cover, such as a tarp, is pulled over the inflated balloon. When the tarp is finally manipulated into its final position, it is secured in place by tying or anchoring it to the side and/or the deck of the pool.

Plastic pool covers are practical in that they prevent leaves, branches, snow, and rainwater from entering the pool, creating a soupy green mess, and damaging the interior and operational mechanics of the pool. Unfortunately, because of their very function, removing a pool cover at the start of a summer season can be extremely difficult. As many pool owners would attest, attempting to pull a cover, loaded with broken twigs, soggy leaves, particles of paper, and similar debris, and which is heavily weighted with gallons of rainwater and melted snow, without spilling the contents of the cover into the swimming pool, can be nearly impossible. Requiring the awkward removal of this debris before the cover can be lifted from the pool, preparing a swimming pool for summertime use can be an extreme hassle.

SUMMARY OF THE INVENTION

Accordingly, a need remains for an inflatable pool cover in order to overcome the above-noted shortcomings. The present invention satisfies such a need by providing a pool cover that is convenient and easy to use, is durable, and offers the owners of residential and commercial swimming pools a simple and efficient means of preventing debris from collecting on their pool cover during winter months. Use of the inflatable cover advantageously ensures that the pool remains clean and free of debris. Furthermore, the assembly also prevents heavy rainwater, melted snow, and sleet from collecting on the top of the cover, thus enabling consumers to remove their pool cover in a quick and easy manner. Ideal for use with both aboveground and in-ground swimming pools, the inflatable cover is versatile and serves a variety of useful applications.

The typical style tarp doesn't work as everyone knows, and inflatable swimming pool cover that doesn't maintain tautness doesn't work either. Rain, snow, leaves, bugs, debris, and algae collect in puddles where the pool cover is slack, and those puddles can remain for eight to nine months at a time. These puddles can also raise health issues with *E-coli*, Cyanobacteria, airborne illnesses and mosquitos. The present invention offers a solution to solve the problem of inflatable swimming pool cover that don't work as promised. The problem is that a user can't just attach a cord, cable, rope, cinch, bungees etc. to thousands of pounds of pressure and expect it to stay taut, as there is nothing to hold the cover taut. That is, standard cables, ropes, cinches etc. don't stay in place—they slide up to under the pool rails from the pressure of the cover's air bubble against the water surface, causing the cover not to be taut. Using stakes in the ground with flexible bungee cords holds the pressure/tautness of the inflatable swimming pool cover in place without tearing the cover, but this arrangement can be unsightly and increases the unusable area of a pool owner's yard when the pool is covered. The present invention provides a proven solution that works.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF EXEMPLARY EMBODIMENTS

The invention summarized above and defined by the enumerated claims may be better understood by referring to the following description of exemplary embodiments thereof, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

The figures generally include various perspective and cross-sectional views showing an inflatable cover, in accordance with the present invention. The assembly of this invention is referred to generally in the figures and is intended to provide an inflatable cover, particularly for pools and hot tubs. It should be understood that the assembly may be used to cover many different types of pools and should not be limited in use to only residential aboveground pools. The inflatable cover described herein can also be used for in-ground and commercial pools, as well as hot tubs, fountains, fishpond, and the like.

Figure 1:
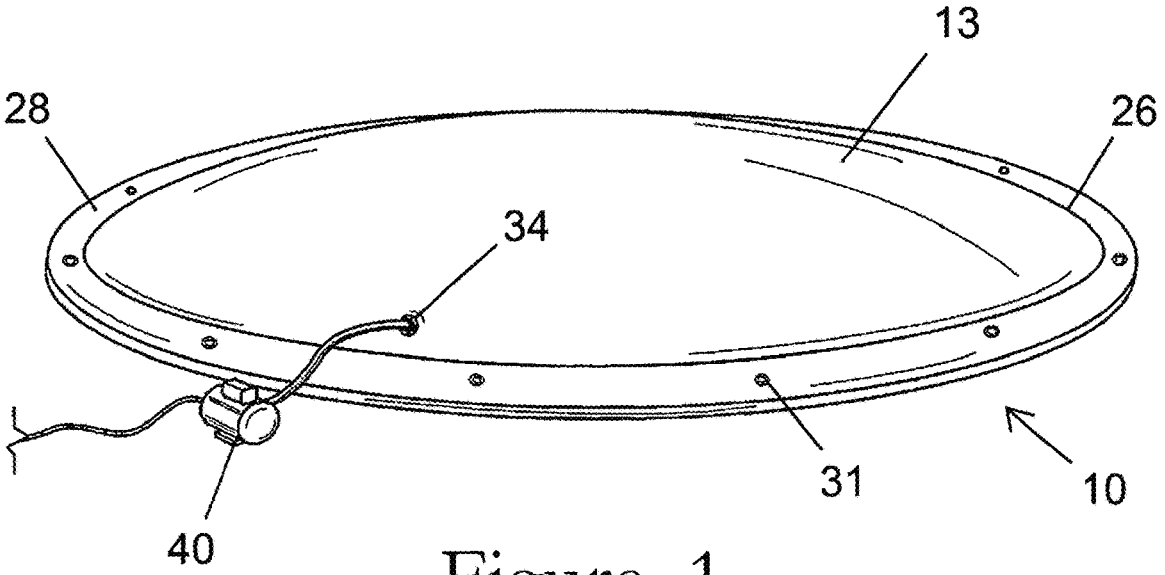
FIG. 1 is a perspective view of an inflatable cover according to a first embodiment of the present invention.
Figure 2:
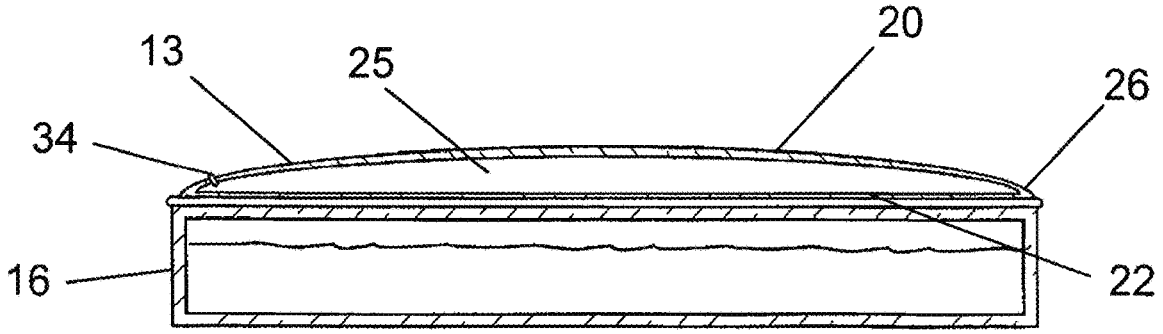
FIG. 2 illustrates a side cross-sectional view of an installed inflatable cover according to a first embodiment of the present invention.

Referring to FIGS. 1 and 2, a cover assembly, indicated generally as 10, includes an inflatable, dome-like sheet 13 that is configured to rest atop an existing swimming pool 16. The dome-like sheet 13 has a top layer 20 and a bottom layer 22, creating a single inflatable chamber 25 therebetween. The top layer 20 and bottom layer 22 are connected and sealed only along an outer periphery 26 of both by heat sealing, sonic welding, adhesives, or other conventional techniques. The dome-like sheet 13 is produced from heavy duty, plastic or rubber material, which is well suited for extended periods of outdoor use. The dome-like sheet should be formed from materials selected for their ability to withstand heat, cold, and ultraviolet rays. For a round pool, the dome-like sheet 13 has a substantially circular shape. In a particular embodiment, the cover assembly 10 measures approximately twenty-one feet (21') in diameter, wherein the inflatable portion of the cover assembly 10 measures approximately twenty feet, two inches (20' 2"). Of course, the cover assembly 10 may be produced in a variety of sizes and shapes appropriate for use with various aboveground and in-ground swimming pools, as is obvious to a person of ordinary skill in the art. For example, the cover assembly 10 may be configured for circular, rectangular, kidney, or oval-shaped pools and sized to accommodate pools of various dimensions.

Extending along a perimeter of the cover assembly 10 is a border 28, which may be an extension or the top layer 20, bottom layer 22, or both. Alternatively, the extension 28 may be a separate piece attached about the outer periphery 26. The border 28 is approximately ten inches wide. Of course, other widths for the border 28 can be used as is obvious to a person of ordinary skill in the art. A plurality of openings 31 may be provided around the border 28. Preferably, the openings 31 are equidistantly spaced around the border 28, and more preferably, the openings 31 are spaced approximately every 15-inches. In a preferred embodiment, the openings 31 are circular shaped and may be fitted with grommets for use with a tether or cable 32 for conveniently and effectively securing the cover assembly 10 to the sides of the pool 16. The tether or cable 32 can be threaded into the plurality of openings 31. In some embodiments, the cover assembly 10 is sized and configured to fit over the top edge of a wall of the pool 16. In such embodiment, the cover assembly 10 of the present invention can substitute for a conventional pool cover. In an alternate embodiment, the cover assembly 10 is sized and configured to fit inside the top edge of the pool. In such alternate embodiment, the cover assembly 10 of the present invention is used with a conventional pool cover.

According to a preferred embodiment, the cover is reversible with K80, ANTI-UVO, 3P-heat resistant and −25° F.

cold resistance on both sides. Accordingly, the cover of the present invention does not need to have one side always facing downward to prevent the penetration of light for algae grown prevention as do prior art covers. Typical covers are usually tan, green, camo, etc. on top with a black, dark bottom to avoid light passage for the prevention of algae formation/growth.

The benefits of this feature are manifest. The user can reverse the cover when one side fades from sunlight, weather, and chemicals and still have a new looking cover. The cover is manufactured with anti-UV coating, so as to prevent the passage of light from either side to prevent algae growth. In addition, with the 3P heat-resistant and −25° F. cold resistant material, the cover can withstand extreme cold allowing it to flex with night temps (tighten) and flex back (loosen) with warmer daytime temps.

Figure 3:
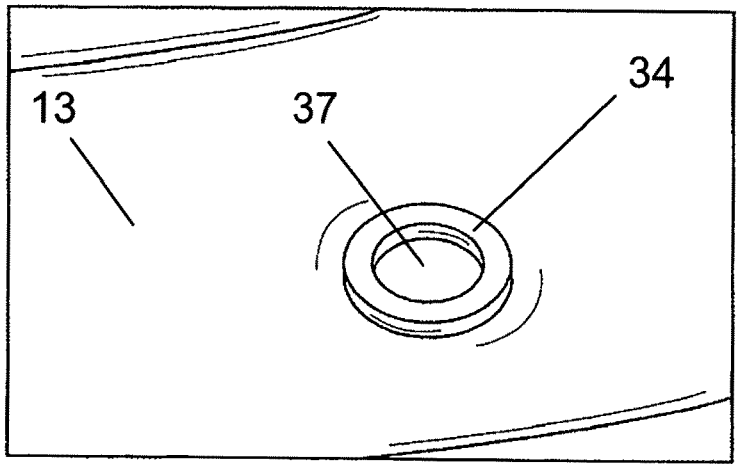
FIG. 3 illustrates a holding ring according to a first embodiment of the present invention.

Referring to FIG. 3, at least one air valve 34 a positioned proximal to the outer edge of the dome-like sheet 13. Generally, the air valve 34 would be circular shaped; however, other shapes may be used. Said at least one air valve 34 is connected to an opening 37 in the top layer 20. Air valve 34 can be positioned in a first (open) position and a second (closed) position. In the first (open) position, the air valve 34 provides an opening to enable air to be admitted into chamber 25. In the second (closed) position, the air valve 34 provides a seal to prevent air within the chamber 25 from leaking out of the chamber 25. In some embodiments, a reinforced cover (not shown) may be provided for the air valve 34. The at least one air valve 34 is configured so that it can be attached to an air pump 40 or other appropriate source of air to inflate the cover assembly 10. The at least one air valve 34 is used in conjunction with air pump 40, thus advantageously enabling a user to quickly and easily inflate the cover assembly 10. For example, a standard ShopVac® can be used to inflate the cover assembly 10. In a preferred embodiment, the air pump 40 could be included for sale with the cover assembly, as is obvious to a person of ordinary skill in the art. In some embodiments, the air pump 40 may be electrically operated, powered by a cord or by battery. In other embodiments, the air pump 40 may be manually operated.

Figure 4:
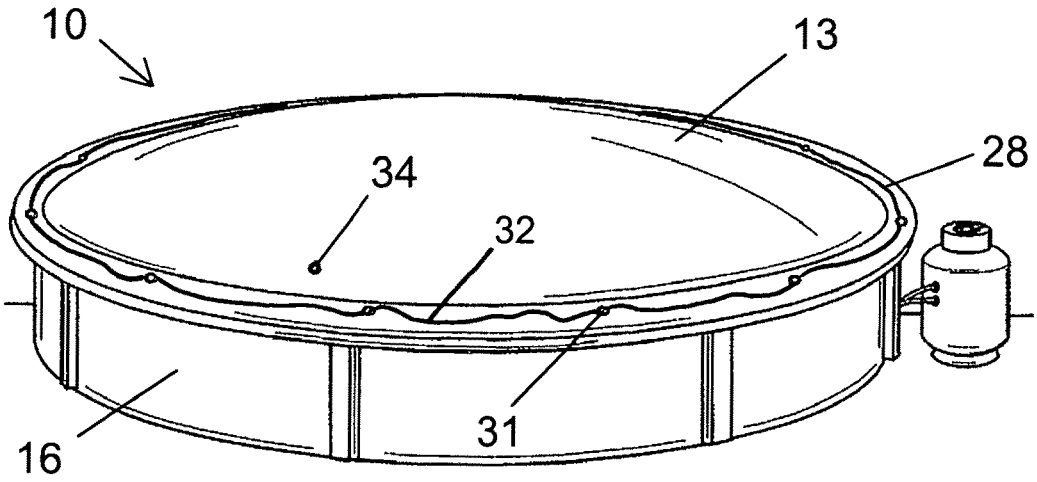
FIG. 4 shows a perspective view of the inflatable cover of FIG. 1 in an installed configuration according to a first embodiment of the present invention.

In use, the cover assembly 10 is very simple and straightforward to operate. First, the user purchases a cover assembly 10 sized and configured in accordance with the size and shape of their pool or hot tub. After preparing their pool for the winter months by conditioning the water, the user positions the cover assembly 10 so that it rests directly above the pool 16, then attaches a tether or cable 32 around the pool 16 through the openings 31, see FIG. 4. In an embodiment where the cover assembly 10 fits inside the top edge of the pool 16, the user should place a conventional cover over the pool after positioning the cover assembly 10 on the pool 16. Next, using an air pump 40, the user fills the inflatable chamber 25 of the cover assembly 10 with air. Once inflated, the dome-like sheet 13 assumes a convex shape that effectively provides an impenetrable umbrella, which completely shrouds the pool while effectively repelling sticks, leaves, rainwater, and snow, which is essential for preventing debris from collecting on the top surface of the cover assembly 10. After proper installation, the cover assembly 10 is left in place throughout the autumn, winter, and early months of spring, conveniently protecting the pool until the weather is warm enough to prepare the pool for use. After use, the cover assembly 10 is quickly and easily deflated by opening the at least one air valve 34, and the cover assembly 10 is removed and stored away along with other pool accessories, until again needed. If desired, a ShopVac® can be used to remove the air from the cover assembly 10.

Figure 5:
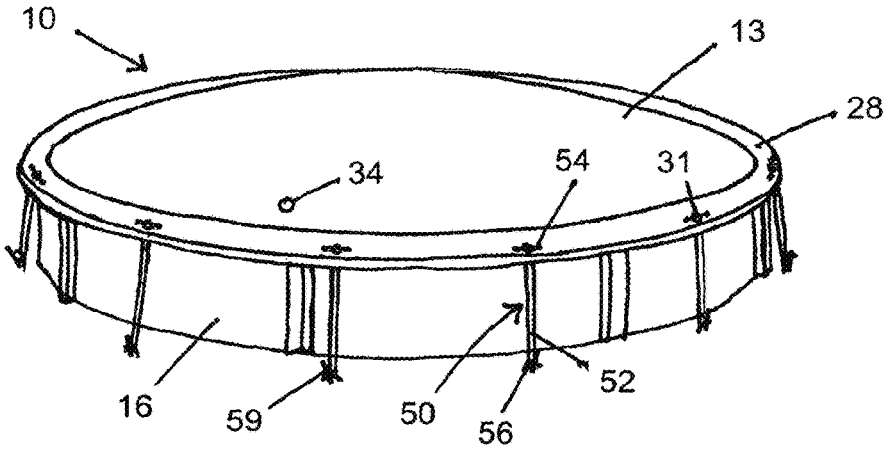
FIG. 5 illustrates a perspective view of an installed inflatable cover including a securing assembly according to an embodiment of the present invention.

In another embodiment shown in FIG. 5, the cover assembly 10 includes a securing assembly 50 for affixing the cover assembly 10 to the ground or other surface on or in which the pool 16 is installed. It is to be understood that the description provided for securing assembly 50 is of a general nature and that multiple, similar assemblies are shown as being used in FIG. 5. Therefore, the description provided for securing assembly 50 is applicable to all such similar assemblies shown in FIG. 5. The securing assembly 50 includes a tie-down member 52 having an anchor device on each end, which on one end connects with dome-like sheet 13 and on the other end connects with a stake or other appropriate ground attachment device 59 in the surface upon which the pool 16 rests. It is contemplated that the connection of tie-down member 52 may or may not be with the border 28 of the dome-like sheet 13.

In a preferred embodiment, one end of the tie-down member 52 is connected to a first anchor device 54. In the current embodiment, the first anchor device 54 may be a tether that is sized and configured to operationally engage with any one of the plurality of openings 31 of border 28. The first anchor device 54 provides a stop for retaining the positioning of the securing assembly 50 relative to the border 28 of dome-like sheet 13. In some embodiments, at least a portion of the tie-down member 52 may also engage through openings 31 to allow the position of the first anchor device 54 to be secured relative to border 28. The other end of the tie-down member 52, opposite the end that is connected to the first anchor device 54, has a second anchor device 56. In the current embodiment, the second anchor 56 comprises a ring, loop, or knot that can be connected to a ground attachment device 59 that can be inserted into the surface upon which the pool 16 rests and provides for the secure positioning of tie-down member 52 relative to that surface.

It is contemplated that the first and second anchor devices 54, 56 may employ various technologies and use various mechanisms to achieve their operational purpose as may be contemplated by those skilled in the art. In the current embodiment, the first and second anchor devices 54, 56 are integrally formed with the respective ends of tie-down member 52. The first and second anchor devices 54, 56 may be a knot, a hook, a toggle, a clasp, or a clip, etc. as may be contemplated by those skilled in the art. In the alternative, either or both of these features may be removed from its connection with its respective end of tie-down member 52. Thus, the current invention contemplates a modular capability that allows the interchanging of different mechanisms and/or technologies for operational use with tie-down member 52.

Figure 6:
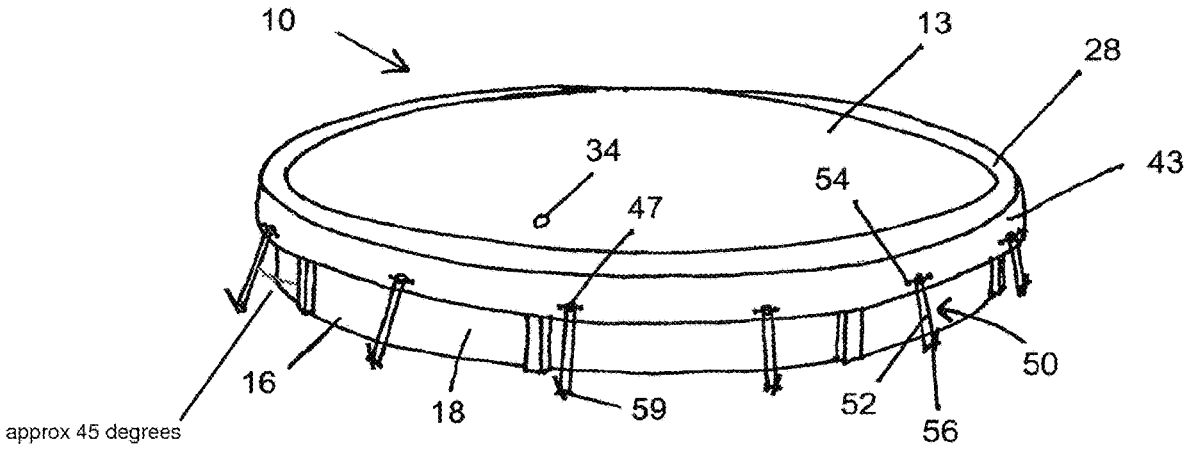
FIG. 6 illustrates a perspective view of an installed inflatable cover including a securing assembly according to an embodiment of the present invention.

Referring to FIG. 6, a cover assembly 10 is shown having a dome-like sheet 13 incorporating a skirt 43 that includes a plurality of openings 47 around the periphery of the skirt 43. Preferably, the openings 47 are equidistantly spaced approximately every 15-inches around the skirt 43. The skirt 43 may be an extension or the top layer 20, bottom layer 22, or both. In one embodiment, the skirt 43 is integrally formed with and extends from periphery 26 of the dome-like sheet 13. In the alternative, the skirt 43 may be removably attached to the periphery 26 allowing for the interchanging of different skirts of various sizes and configurations. The mechanisms and technology employed to accomplish the modular interchangeability for the skirt(s) 43 and border 28 may vary as contemplated by those of ordinary skill in the art. It is further contemplated that the skirt 43 may be integral with or modularly connectable with the dome-like sheet 13 directly. The skirt 43 is sized and configured to extend a distance down and to overlap the outside of pool wall 18. In a preferred embodiment, the skirt 43 extends at least 24-inches down the side of the pool wall 18, which provides protection for at least a portion of the pool wall 18. Thus, the skirt 43 may have various dimensions without departing from the scope and spirit of the present invention.

In a preferred embodiment, the skirt 43 positions the plurality of openings 47 relative to the ground and the securing assemblies 50. Preferably, in an installed position, the skirt 43 forms an angle of approximately 45° with the pool wall 18. In the alternative, skirt 43 may be sized and configured to substantially extend to and/or operationally engage with the surface upon which the pool 16 rests. In such an embodiment, the skirt 43 would allow a ground attachment device 59 to secure the skirt 43 to the surface simply, without requiring a tie-down member or other device to operationally connect the skirt 43 with the surface.

As described above, with reference to FIG. 5, the cover assembly 10 includes a securing assembly 50. In a preferred embodiment, the securing assembly 50 includes a tie-down member 52 connected on one end with a first anchor device 54 and on the opposite end with a second anchor device 56. The securing assembly 50 operationally connects with the plurality of openings 47 around the periphery of the skirt 43 on one end and, on the other end, secures to a ground attachment device 59 connected to the surface upon which pool 16 rests. The securing assembly 50 may be formed integrally to or be modularly connectable with the border 28, skirt 43, and/or directly with the dome-like sheet 13.

Tie-down member 52 may be of various design and material, for instance, the tie-down member 52 may be a strap, rope, cable, elastomeric cord, or otherwise, as may be contemplated by those skilled in the art. The tie-down member 52 may be variously sized and configured to accommodate the needs of a user and the needs of the cover assembly 10. For instance, the length of the tie-down member 52 may be varied or the tie-down member 52 may include an adjustment mechanism whereby a user is able to adjust the overall length of the tie-down member 52 and securely affix that length. It is contemplated that the tie-down member 52 may not require the use of the first anchor device 54; instead, the tie-down member 52 may thread through the plurality of openings 31, 47. Further, the tie-down member 52 may be integrally formed with the dome-like sheet 13 and not be required to operationally interact with the plurality of openings. Additionally, the tie-down member 52 may include one or more stops within the body of the member itself. For instance, a cord member may include one or more knots within the body that can operationally be engaged with either one of the anchor devices 54, 56 to secure a position.

The number of securing assemblies 50 employed with any given cover assembly 10 may be determined by the number of openings found in the dome-like sheet 13. It is contemplated that the number of securing assemblies 50 employed with any given cover assembly 10 may be more or less than the total number of openings. In an alternative embodiment, the securing assembly 50 may thread a single tie-down member 52 through one or more of the plurality of openings 31, 47, engaging its anchor device 54 with only one of the openings. It is further contemplated that the ground attachment device 59 embedded in the surface upon which the pool 16 sits can operationally connect with more than one tie-down member 52.

In another alternative embodiment, the skirt 43 may include a weighted outer edge that operationally secures the position of the skirt 43 relative to the pool 16 and/or the surface upon which the pool 16 rests. For instance, the weighted outer edge of the skirt 43 may "hang" at various positions relative to the wall 18 of the pool 16, or the weighted outer edge may rest upon the surface upon which the pool 16 rests. Those skilled in the art will understand that various weighting mechanisms and technologies may be used, such as lead weights enveloped within the outer edge of skirt 43, without departing from the scope and spirit of the current invention. It is contemplated that the weighting mechanisms may be integrally formed with and/or removable from the skirt 43, thereby, allowing for the insertion of the weighting mechanisms into the skirt 43 after the dome-like sheet 13 has been positioned relative to the pool 16. Thus, the outer edge of the skirt 43 may include various constructs that allow the weighting mechanisms to be inserted and removed as contemplated by those skilled in the art.

Figure 7A:
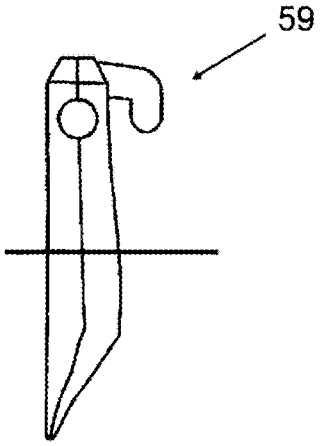
FIGS. 7*a* and 7*b* show examples of ground attachment devices according to an embodiment of the present invention.
Figure 7B:
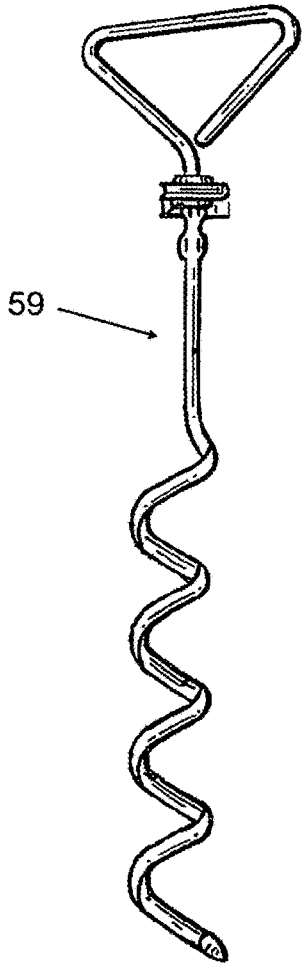

FIGS. 7*a* and 7*b* show examples of ground attachment devices 59 according to the present invention. FIG. 7*a* shows a simple stake, such as a tent stake, that can be used to connect a securing assembly 50 to the ground. FIG. 7*b* shows a heavy-duty stake that can be used in areas expecting windy conditions. Other ground attachment devices, such as pegs, rebar, poles, etc. can be used.

In another embodiment, the securing assembly 50 may not require connection to a ground attachment device 59 for insertion into a surface. For instance, the securing assembly 50 may further include a weighted catch to which the members may connect, whereby the weighted catch itself rests on the surface. The weighted catch may itself be secured to the surface using various mechanisms, devices, and technologies as contemplated by those skilled in the art.

Figure 10:
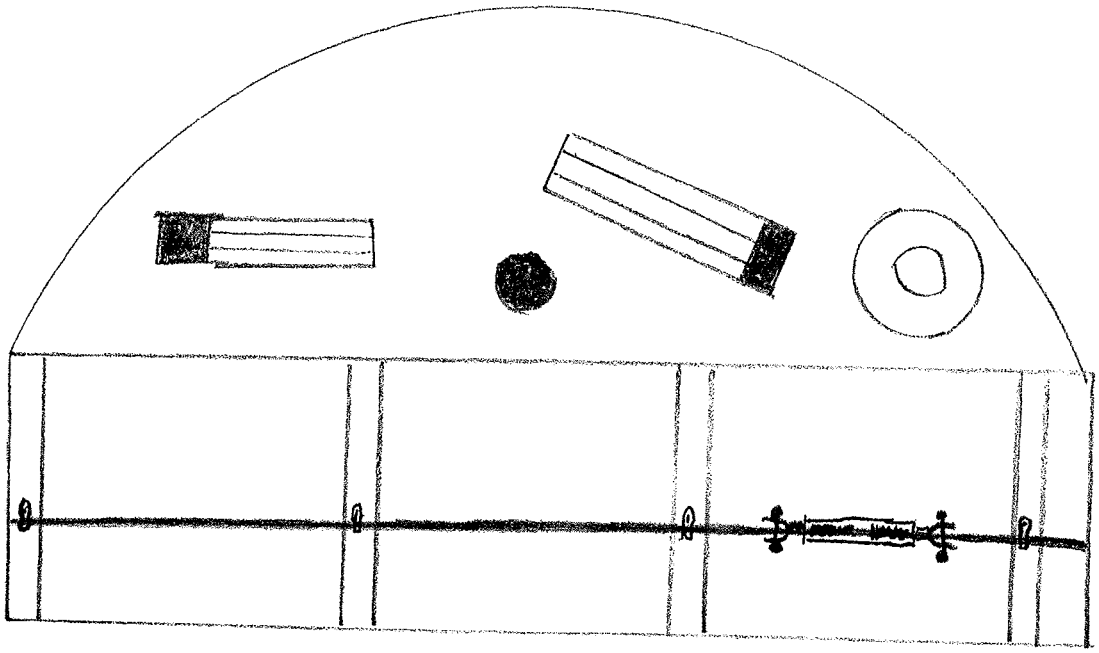
FIG. 10 shows a portion of a preferred securing system according to the invention, left attached to the pool during the swimming season.
Figure 11:
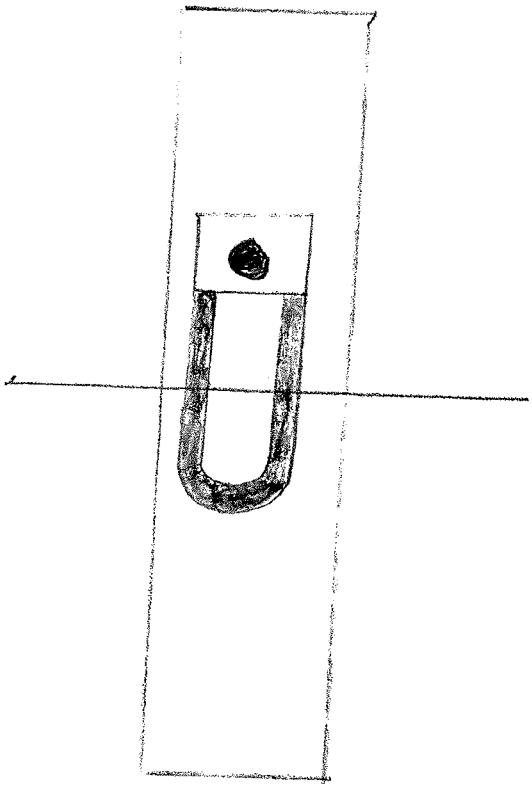
FIG. 11 shows a portion of a preferred securing system according to the invention.
Figure 12:
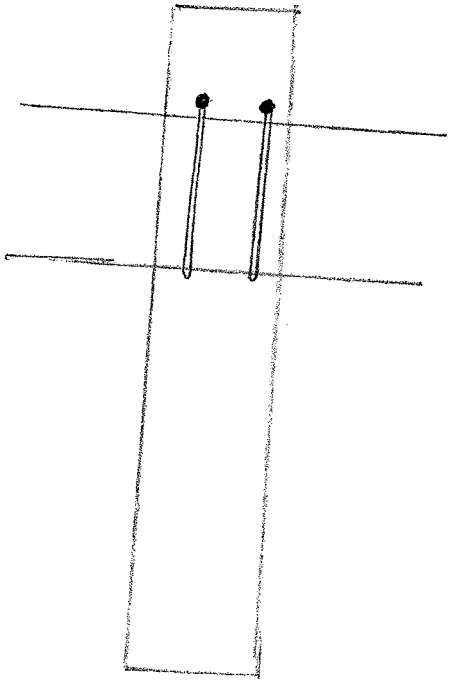
FIG. 12 shows another portion of a preferred securing system according to the invention.
Figure 13:
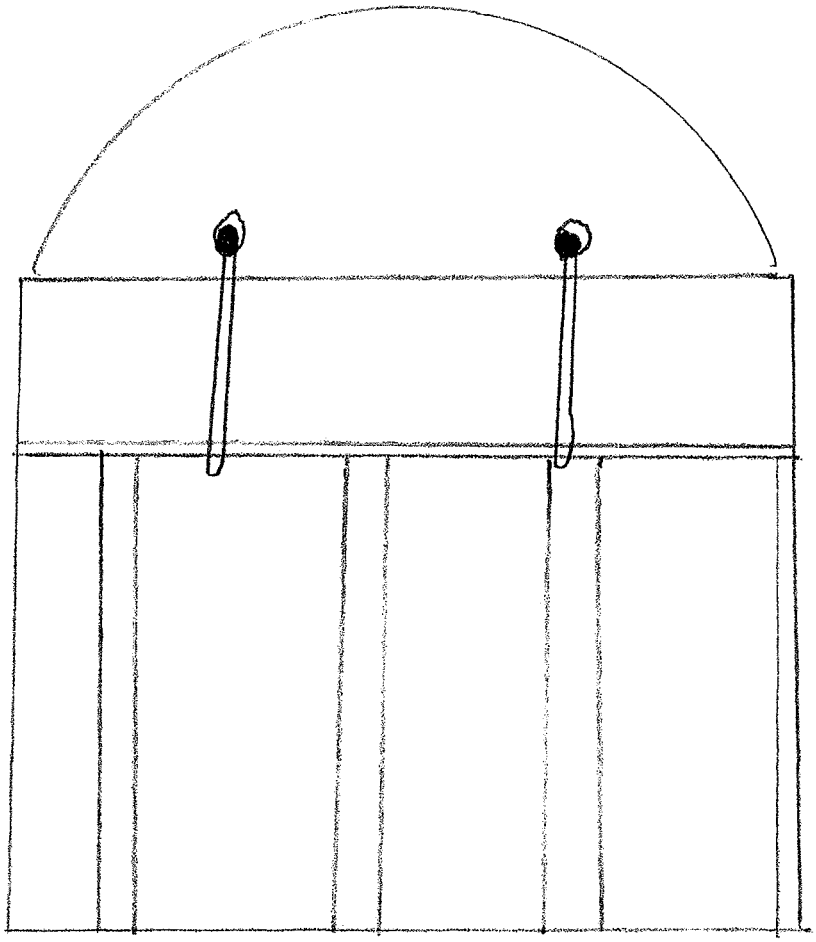
FIG. 13 shows another portion of a preferred securing system according to the invention.
Figure 14:
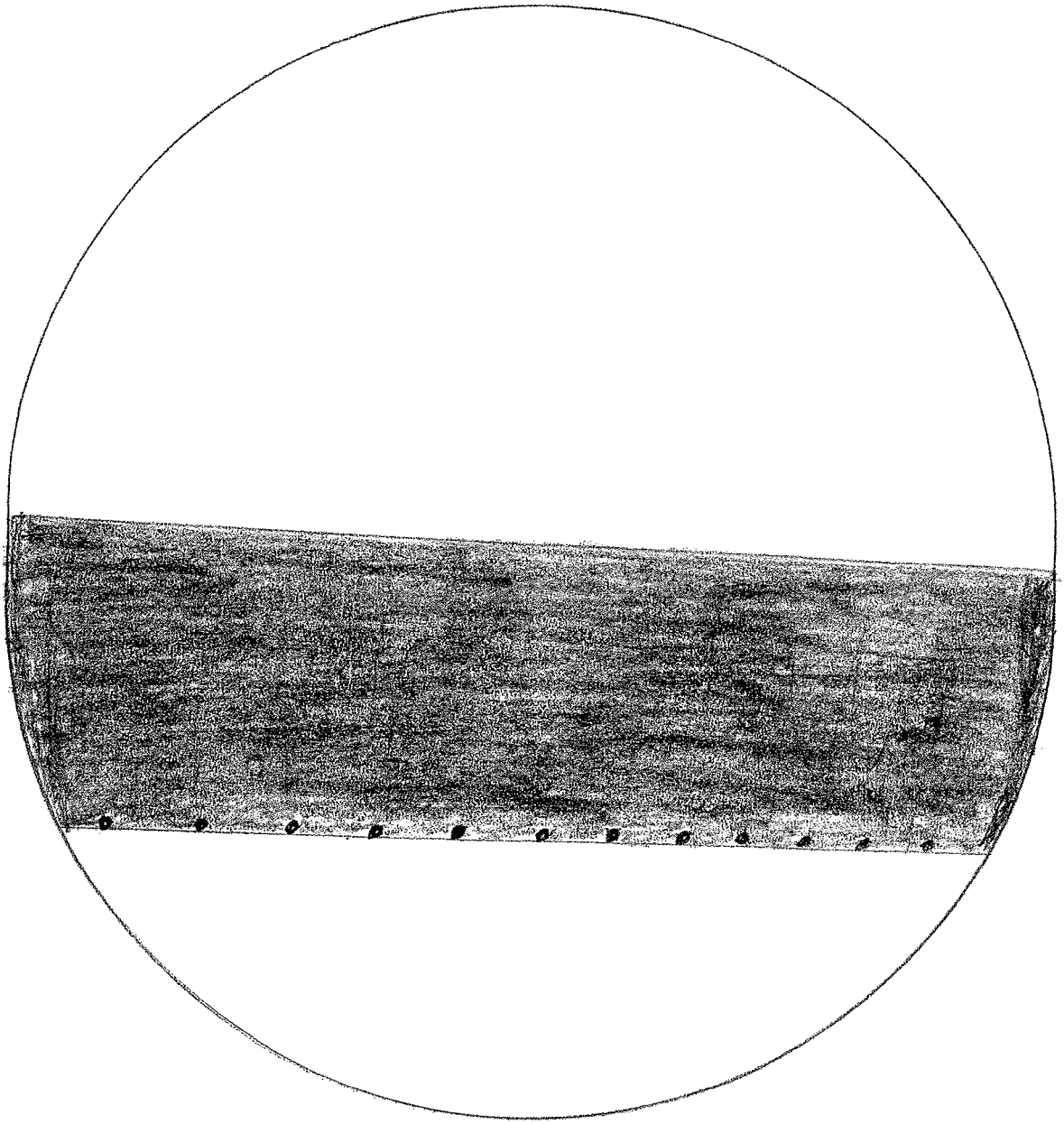
FIG. 14 shows an inflatable pool cover according to the invention outside of a pool to show how the inflation chamber can be expanded to fill nearly an entire volume of a pool and provide support for the pool walls from inside when the pool has lost water.
Figure 15:
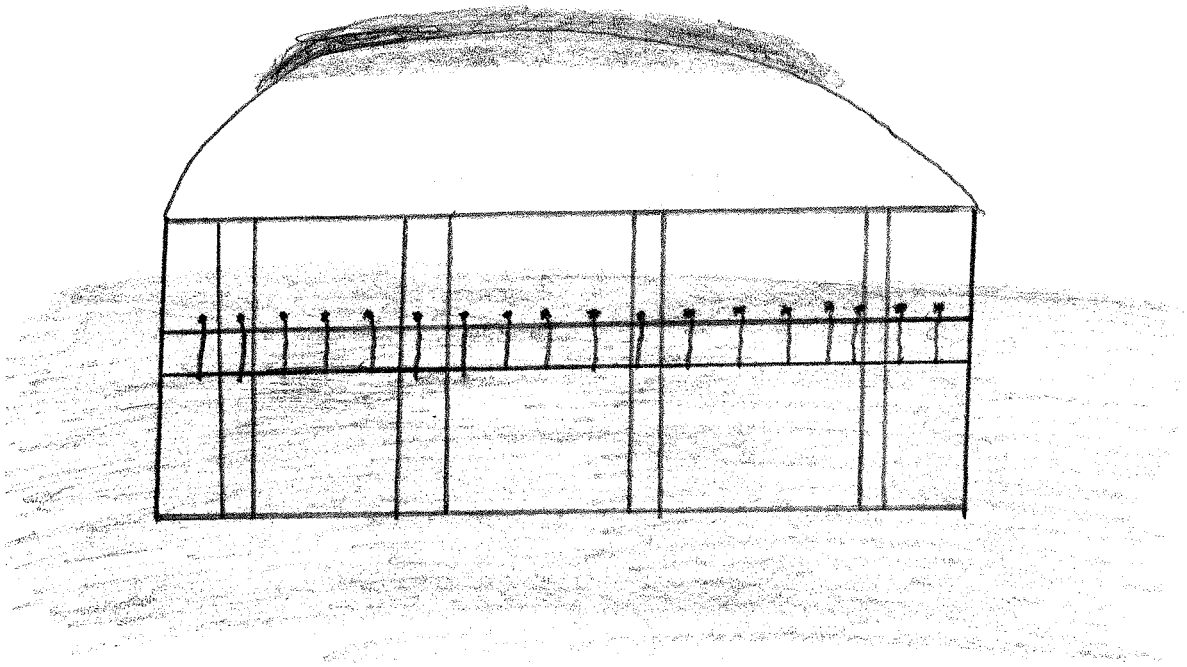
FIG. 15 shows the inflatable pool cover and securing system of FIG. 14, after the snow has begun to melt and showing that no water or slush is accumulating at the edge of the inflatable portion of the pool cover.

According to an improved method and apparatus for securing the cover to an above-ground pool, there is optionally no attachment or securing of the cover to the ground. Instead, the pool cover is secured directly to the pool structure itself. Support post or reinforcing posts (also referred to herein as "uprights") are located around the perimeter of the pool and serve to strengthen and maintain the pool wall in the desired position. See, e.g., FIGS. 1 and 10. Conventionally, various components make up these posts assemblies and may include upper and lower rails for engaging and covering the upper and lower edges of the metal pool wall. Some form of plate connectors serve to mount the vertical posts in position and may also be used to secure sections of ledges around the top of the pool wall. Some form of cap is usually fastened to finish the top of post assembly. The posts are the main support of the swimming pool also the main support of the inflatable swimming pool cover.

Figure 8:
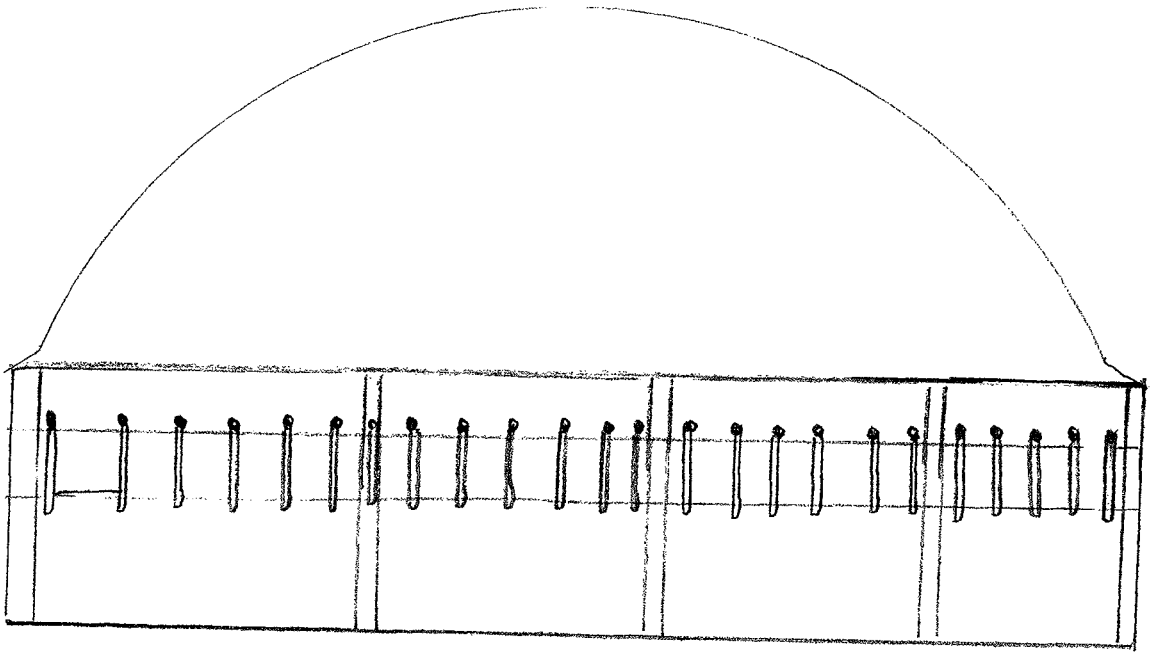
FIG. 8 shows an inflatable pool cover according to the invention secured to an above-ground pool using a preferred securing system according to the invention.
Figure 9:
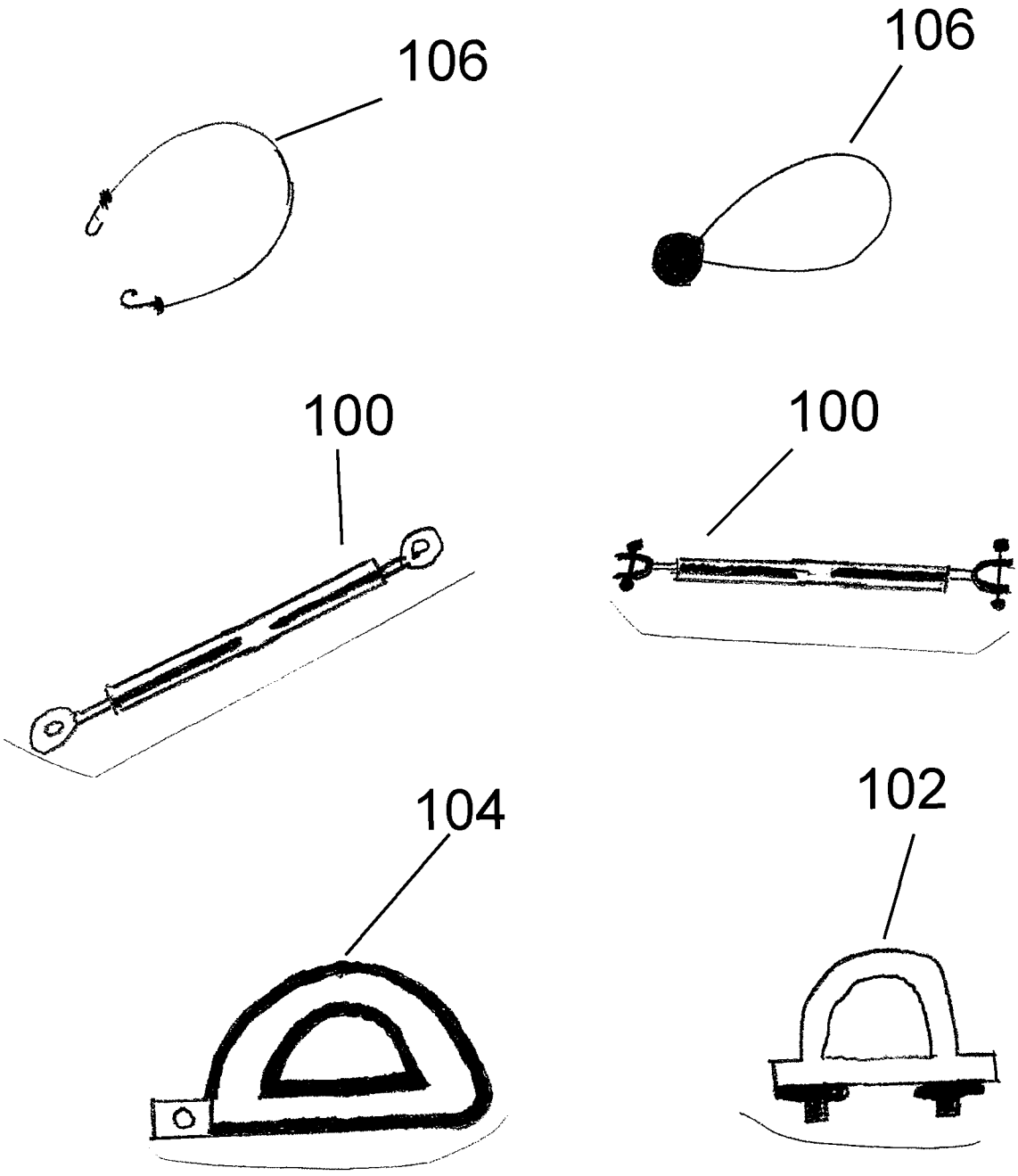
FIG. 9 shows various elements of a preferred securing system according to the invention.

According to this improved method and apparatus, a cable is securely fastened to the uprights of the pool support structure, around the outside perimeter of the pool, at a uniform distance from the top rail of the pool structure, below where the pool cover skirt reaches before the cover is inflated. See FIGS. 8 and 10. The cable is preferably a heavy duty stainless and/or galvanized wire cable, opposite ends of which are connected to one-another with a turnbuckle or other cable-tensioning system. See FIG. 9, elements 100. A turnbuckle is a heavy duty tensioning system typically consisting of two threaded eye bolts, one screwed into each end of a metal frame, one with a right-hand thread and the other with a left-hand thread. The tension can be adjusted by rotating the frame, which causes both eye bolts to be screwed in or out simultaneously, without twisting the eye bolts or attached cables.

According to the turnbuckle system, each end of the cable may be threaded through an eye-bolt and secured to itself with a U-bolt cable clamp 102. The heavy duty galvanized wire cable will last interminably or certainly over the life of the swimming pool. It will not rust or break. Other methods like rope will rot causing the entire pool cover system to fail. Thin cable will break with the amount of pressure being put on it when the inflatable pool cover is inflated.

At each pool support upright, the cable is secured to the upright with a rubber sleeved or coated steel cushion clamp 104. The rubber lined clamp secures the heavy duty stainless, galvanized wire cable and protects the pool structure, preventing or limiting the wire from rubbing due to friction of bungees, thus reducing stress on the heavy duty stainless, galvanized wire cable.

The cushion clamp may be secured to the upright using a self-tapping screw, preferably using a lock washer. Self-drilling hex screws prevent stripping the screw and damage to the support posts of swimming pool from an ordinary screwdriver. The lock washer prevents screw from shearing through the support system to maintain secure and without comprising the structure of the swimming pool.

In this fashion, the cable is very tightly secured to the pool uprights at a pre-determined distance from the top rail of the structure, and also below the lower edge of the pool cover skirt. The pool cover skirt is fitted with reinforced grommets spaced every 15 inches around the perimeter of the pool cover skirt. To secure the pool cover to the pool, one end of a bungee cord 106, preferably nylon wrapped rubber stranded bungee, is hooked through a grommet. Flexible bungees allow for the inflatable swimming pool cover to move with wind, and other elements of weather to prevent tearing and to maintain tautness. Flexible bungees are needed to allow movement of the cover with the change in temperature and wind conditions. If the bungees are not flexible, the cover will rip/tear and comprise the entire system. The bungee cord is then threaded down and around (under) the securing cable, and back up to the edge of the pool skirt and the second end of the bungee cord is hooked into an adjacent grommet. Alternatively, each bungee may be hooked at one end to a first grommet, threaded down and under the securing cable and back up to the edge of the pool skirt, but hooked into the same grommet. The multiple of reinforced brass grommets spaced fifteen inches apart throughout the entire cover distributes the force on each grommet to provide the required tension to the skirt without putting undue stress on any one grommet. The multiple reinforced brass grommets make it taut but not stressed. This system works because the multiple of reinforced brass grommets spaced close together (every 15 inches) reduces the stress pounds of pressure on the inflatable swimming pool cover to restrain against wind, snow, weight of debris, harsh weather and to allow movement of the bungees that are flexible to prevent tearing and to maintain tautness that makes the inflatable swimming pool cover work. The grommets are preferably brass, 28 mm in size, to hold the tautness, pressure without tearing or compromising the entire cover system. When grommets tear out, especially with water, rain, snow, sleet, running down the side/edge of cover, water and debris is retained in pockets that form in the skirt causing damage to the cover and putting additional pressure on seams which in turn can cause tears that can compromise the air seal which in turn compromises the entire cover.

The grommets are reinforced with polyester PVC material welded around grommets between upper and bottom layers. They are reinforced with strengthening material to endure pressure, force and maintain securely connected without ripping, tearing the reinforced material of the inflatable swimming pool cover, or heat welding, etc. anywhere on inflatable swimming pool cover. It allows for even distribution on flexible bungees cords to distribute energy on all grommets. It redistributes the force on one grommet and is reduced by 50% to maintain force, a constant effect, tautness, of wind, weather, weight of debris, harsh weather throughout the entire bladder, inflatable inner chamber, (entire body of water, rails, swimming pool causing a roll-off effect.)

This secure tightening system to maintain tautness for extended periods of time has been tested for over two years, maintaining tautness without tearing the reinforced brass grommets, eyelets around outer edge of reinforced material, cover, that would create it to loose height, tautness of air in the inflatable swimming pool cover. This system has been tested and has proven to work without compromising the inflatable swimming pool cover.

To install and secure the inflatable pool cover of the invention, the securing assembly operationally connects with the plurality of reinforced grommets around the outer skirt of swimming pool cover. Measuring a uniform distance from the pool edge, self-drilling screws are used to attach rubber lined clamp in place with a lock washer. This is repeated at each support post along the outer pool wall until all support posts are installed with rubber lined clamp using lock washers and self-drilling screws. Heavy duty stainless, galvanized wire cable is threaded through the rubber lined clamps and attach each end of the cable to respective eye-bolts of opposite ends of a turnbuckle and secure each end of the cable to itself using a U-bolt. Then tighten the turnbuckle to apply tension to the cable. The skirt of the uninflated pool cover is then secured to the cable using flexible bungies. A bungee is attached to a grommet, run downward under the cable back up and secured to the next grommet. This is repeated until all grommets are secured to the cable using bungies. Complete securing system by turning the turnbuckle to tighten the galvanized, stainless, heavy duty cable. At this point, the securing system is complete, and the inflatable cover is ready to be filled with air using any means of blowing air, shop vac, leaf blower etc. The cover is inflated until the skirt of the cover forms a sloped surface around the entire inflation chamber of the inflatable pool cover, sloping downward to the pool edge, without forming water-collecting spaces so that rain, snow, other water, leaves, and other debris do not collect in the space between the inflation chamber and the pool edge and instead slide off the pool cover entirely and onto the surrounding ground. According to any other system, when the pool cover is inflated sufficiently to allow rain, snow, leaves and other debris to slide off the cover entirely, the pressure on the securing system is so great that the securing system fails in a way that causes water and debris to collect in the skirt portion of the inflatable pool cover. In addition, the extreme stretch-ability of the material of the cover, allows additional air to be added to increase the volume of the inflation chamber as needed. For example, in prior art systems, when water is leaked or otherwise lost from the pool while covered, the pool cover would sag, creating water and debris collecting spaces. According to the present invention, however, when water is lost from the pool for any reason, the inflation chamber of the pool cover may be provided with additional air and the inflation chamber will expand to fill the vacant space. Indeed, if the water level drops below the ½ depth level and/or lower, the inflation chamber may be inflated so that it contacts the pool side and provides lateral support to the pool side, preventing it from collapsing inward due to lack of water. According to various embodiments of the invention, the inflation chamber can be inflated so that it fills more than 30%, more than 40%, more than 50%, more than 60%, more than 70%, more than 80%, and/or even more than 90% of the volume of the pool, as water is lost from the pool. As more water is lost from the pool and the inflation chamber is additionally inflated, it begins to provide lateral support to the pool walls as it pushes against the pool walls from the inside. In fact, the present invention can be used in a pool that is completely devoid of water, providing support to the pool structure from within, and preventing the accumulation of water and debris on top of the cover.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function, and manner of operation. The assembly and use of the present invention are deemed readily apparent and obvious to one skilled in the art.

It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It should be understood, therefore, that the invention may be practiced otherwise than as specifically set forth herein. Consequently, the present embodiments are to be considered in all respects as illustrative and not restrictive.

What is claimed is:

1. An apparatus for preventing debris from entering a pool or like body of water while simultaneously preventing fluids and debris from collecting on top, said apparatus comprising a cover and a securing assembly, the cover consisting essentially of:

a top sheet;

a bottom sheet, said top sheet and bottom sheet connected and sealed to one-another along a circle a pre-determined distance from an outer periphery of said top and bottom sheets forming an inflation chamber inside a perimeter of said circle and a skirt outside said perimeter of said circle, said inflation chamber having at least one air valve proximal to but inside said perimeter of said circle; wherein the skirt comprises an extension of both the top sheet and the bottom sheet; and a plurality of reinforced grommets arranged around a perimeter of said skirt;

the securing assembly comprising:

a heavy-duty cable secured to support pillars of an above-ground pool and attached to itself at opposite ends and tensioned;

a plurality of elastic straps configured to attach to one or more of said grommets and to said heavy duty cable; wherein no portion of said securing assembly is attached to ground;

wherein said skirt forms a descending slope from said inflation chamber to an edge of said pool so that water and debris are prevented from accumulating on said skirt.

2. The inflatable cover according to claim 1, wherein, in a first position, said at least one air valve provides an opening to enable air to be admitted to said chamber.

3. The inflatable cover according to claim 1, wherein, in a second position, said at least one air valve provides a seal to prevent air within said chamber from leaking out of said chamber.

4. The inflatable cover according to claim 1, wherein said at least one air valve is sized and configured to be attached to an air pump.

5. The inflatable cover according to claim 1, wherein said top sheet and said bottom sheet are sealed by a process selected from the group consisting of:

heat sealing;

adhesive; and sonic welding.

6. An apparatus for preventing debris from entering a pool or like body of water while simultaneously preventing fluids and debris from collecting on top, said apparatus comprising a cover and a securing assembly, the cover consisting essentially of:

a top sheet connected and sealed to a bottom sheet along a circle a pre-determined distance from an outer perimeter of said bottom and top sheets forming an inflation chamber therebetween inside a perimeter of said circle and a skirt outside said circle, said inflation chamber having at least one air valve proximal to and inside said circle; and said skirt connected to and extending from said sealed circle, said skirt comprising an extension of both said top sheet and said bottom sheet; and a plurality of reinforced grommets arranged around a perimeter of said skirt;

a securing assembly for affixing the position of the cover, said securing assembly comprising:

a heavy-duty cable secured to support pillars of an above-ground pool and attached to itself at opposite ends and tensioned;

a plurality of elastic straps configured to attach to one or more of said grommets and to said heavy duty cable; wherein no portion of said securing assembly is attached to ground;

wherein said skirt forms a descending slope from said inflation chamber to an edge of said pool so that water and debris are prevented from accumulating on said skirt.

7. The inflatable cover according to claim 6, wherein said top sheet and said bottom layer are sheet by a process selected from the group consisting of:

heat sealing;

adhesive; and sonic welding.

8. The inflatable cover according to claim 6, wherein, in a first position, said at least one air valve provides an opening to enable air to be admitted to said chamber.

9. The inflatable cover according to claim 6, wherein said at least one air valve is sized and configured to be attached to an air pump.

10. A method for preventing the collection of water and debris on a pool cover and for providing lateral support for an above-ground pool, comprising;

covering said above-ground pool with a pool cover, said pool cover comprising:

a single central inflation chamber comprising a top layer and a bottom layer, and a skirt surrounding said inflation chamber, with said single central inflation chamber situated over said pool, and with said skirt extending from said single central inflation chamber to and over an entire perimeter of said pool, a perimeter of said skirt having a plurality of regularly spaced reinforced grommets, said skirt comprising an extension of both said top layer and said bottom layer;

securing said cover to a side of said pool with a securing assembly comprising:

a heavy-duty cable configured to secured to support pillars of an above-ground pool and attached to itself at opposite ends and tensioned;

a plurality of elastic straps configured to attach to one or more of said grommets and to said heavy duty cable; wherein no portion of said securing assembly is attached to ground;

inflating said inflation chamber until said skirt forms a descending slope from said inflation chamber to an edge of said pool so that water and debris are prevented from accumulating on said skirt;

adding air to said inflation chamber as water is lost from said pool; and when a level of water in said pool is ½ or less than a height of said pool, inflating said inflation chamber so that said inflation chamber expands to press against inside surfaces of pool walls to provide support to said pool walls.

11. The method according to claim 10, wherein said inflation chamber is expanded to fill 75% or more of a volume of said pool.

12. The method according to claim 11, wherein said inflation chamber provides the sole internal support for said pool in the absence of water in said pool.

* * * * *